United States Patent [19]

Zimmermann et al.

[11] Patent Number: 4,530,495

[45] Date of Patent: Jul. 23, 1985

[54] PICK-UP UNIT IN A SHEET-TRANSPORTING DEVICE OF A PRINTING MACHINE

[75] Inventors: Hans Zimmermann, Coswig; Fritz Pieper, Radebeul; Hartmut Nagel, Coswig, all of German Democratic Rep.

[73] Assignee: Veb Kombinat Polygraph "Werner Lamberz" Leipzig, Leipzig, German Democratic Rep.

[21] Appl. No.: 553,474

[22] Filed: Nov. 18, 1983

[30] Foreign Application Priority Data

Dec. 1, 1982 [DD] German Democratic Rep. ... 245409

[51] Int. Cl.[3] ..... B65H 29/04

[52] U.S. Cl. ..... 271/204; 271/277; 101/408

[58] Field of Search ..... 271/277, 204, 206; 101/408

[56] References Cited

U.S. PATENT DOCUMENTS 2,984,178 5/1961 Koch ..... 271/206

3,924,849 12/1975 Murakami ..... 271/204 X

FOREIGN PATENT DOCUMENTS 2140442 3/1972 Fed. Rep. of Germany .

*Primary Examiner*—Richard A. Schacher

*Attorney, Agent, or Firm*—Michael J. Striker

[57] ABSTRACT

A pick-up unit in a printed sheet transport device for a printing machine includes a gripper shaft, a number of grippers and a number of corresponding counter gripping members, and a traverse which encloses the gripper shaft and the grippers at three sides. The traverse has a front wall, an upper wall and a rear wall; the latter extends to a plane of transporting of the printed sheet at an acute angle and is formed with a projection which extends inwardly from the rear wall of the traverse.

4 Claims, 2 Drawing Figures

PICK-UP UNIT IN A SHEET-TRANSPORTING DEVICE OF A PRINTING MACHINE

BACKGROUND OF THE INVENTION

The present invention relates to sheet-outfeed units of printing machines, in which the printed sheets are transported from a last printing station to a sheet stack. More particularly, the invention pertains to a pick-up unit, a number of which are arranged on the movable loop chain of the sheet-outfeed unit at equal intervals.

Pick-up units disclosed in DDR patent application No. WPB 41f/240 356 are each provided with a streamline-shaped cover in which the front portion, as viewed in the direction of transporting of the printed sheets, has a cross-section formed as a cut drop. A plate is arranged at the end of the pick-up unit, on which plate counter gripping members are mounted. The disadvantage of this construction of the pick-up unit is that, since the unit is totally covered, the disassembling and reassembling of the grippers become difficult.

Furthermore, the front edge of the printed sheet, while it is passing the region of the dryer, is partially covered by the above mentioned cover whereby the printed sheet in this region can not be completely dried. A non-uniform drying of the sheet unfavorably affects the quality of the printed sheet because some ink remaining at the front edge of the sheet causes the blurring.

A further disadvantage of the known structure of the pick-up unit is that the mounting of the counter gripping members on the plate is expensive because each counter gripping member must be individually adjusted and then additionally rigidly secured to the plate.

A tensile strength of the known sheet-pick-up unit in the plane of the counter gripping members is insignificant because the cover is interrupted in the region where the grippers and counter gripping elements lie opposite each other.

The pick-up unit, which is disclosed in the German patent publication DE-OS No. 21 40 442, is provided with the cover which encircles the gripper shaft, for increasing the moment of resistance. The disadvantage of this construction of the sheet-pick-up unit is that a pair composed of a gripper and a counter gripping member operates centrally in the pick-up unit whereby the transported sheet lies on the portion of the cover. Therefore a pressure and counter pressure of the printed sheets can cause the transferring of the ink onto the cover.

A further disadvantage of the known construction is that a shadow freedom is not warranted during the application of the dryer to the printed sheet and the sheet is therefore not uniformly dried.

SUMMARY OF THE INVENTION

It is an object of the invention to provide an improved pick-up unit in a sheet-transporsing device of a printing machine.

It is a further object of the invention to improve transportation of the printed sheets from the last printing station towards the sheet stack and provide for a uniform drying of the sheets during their transportation.

These and other objects of the invention are attained by a pick-up unit for transporting the sheet along a path from a last printing station to a sheet stack comprising a gripper shaft; a plurality of grippers connected to said gripper shaft and a plurality of counter gripping elements cooperating with the respective grippers for engaging the sheet being transported; and a traverse carrying said counter gripping elements and enclosing the pick-up unit, said traverse including a front wall portion, an upper wall portion and a rear wall portion merging one into another, said rear wall portion extending to a plane of transporting of the sheets at an angle $\alpha$ which is smaller than 90°, said rear wall portion carrying said counter gripping elements and being provided with an inlined projection extended inwardly of said rear wall portion.

According to another concept of the invention the pick-up unit may further include a number of bars outwardly extended from the gripper shaft, said traverse being screwed to said bars.

In accordance with yet another concept of the invention the front wall portion and the upper wall portion are formed with bucklings.

Furthermore, the inclined projection and said rear wall portion may include between each other an angle $\beta$ which is $\leqq 90°$.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
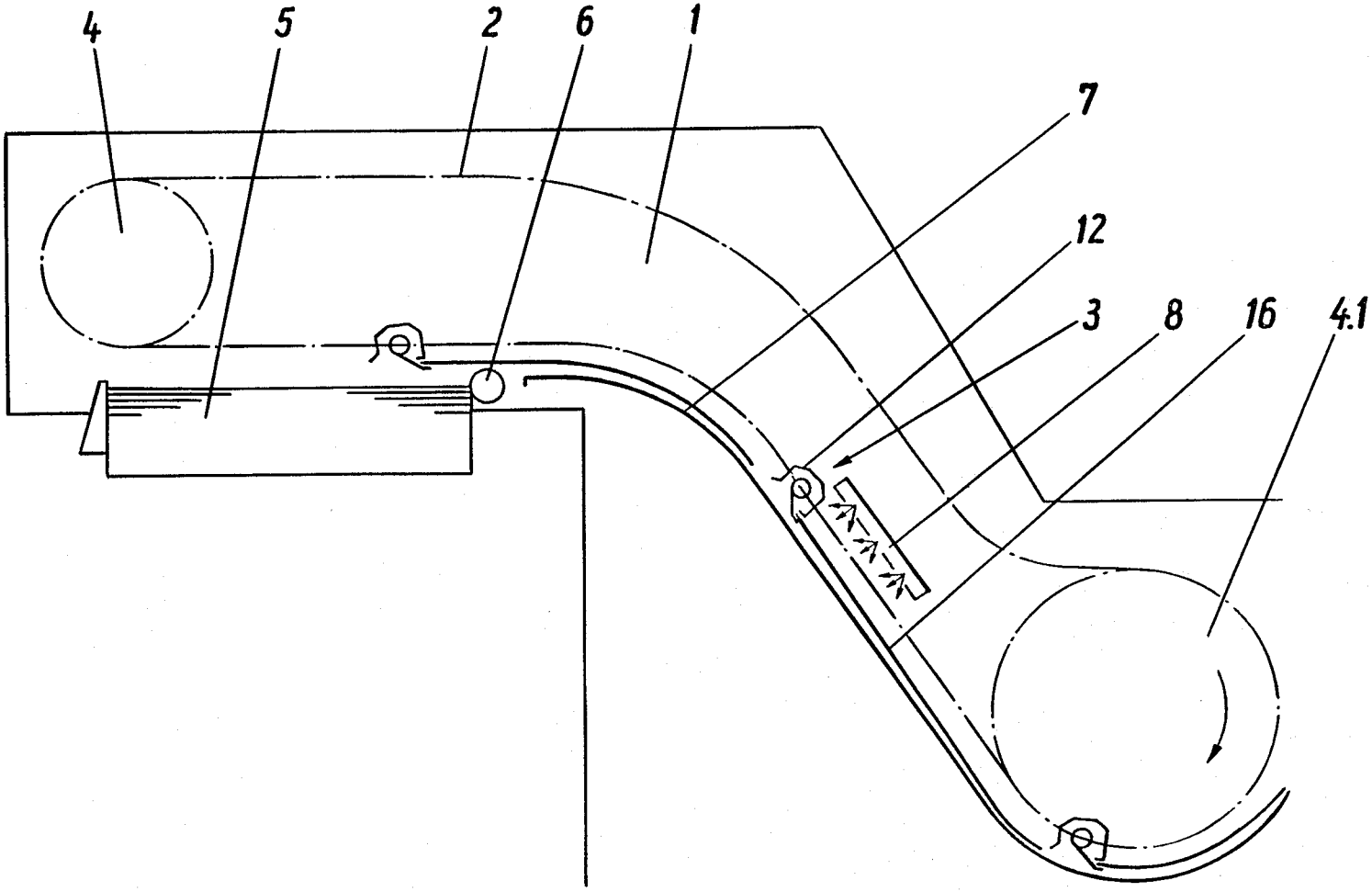
FIG. 1 is a simplified schematic side view of the sheet-outfeed unit of a printing machine, provided with sheet pick-up units according to the invention.

FIG. 1 illustrates a schematic side view of the sheet-outfeed unit of a printing machine, which serves to transport printed sheets from the printing stations or mechanisms and deposit those sheets onto the outfeed stack. The sheet-outfeed unit which is generally designated by reference numeral 1, includes a chain loop 2 on which are arranged at equal intervals pick-up units 3. The chain loop 2 travels about two sprocket wheels 4 and 4.1. The direction of rotation and thus the direction of travel of chain loop 2 is shown in FIG. 1 by the arrow. A sheet stack 5 is disposed below the sheet outfeed unit 1 to receive the printed sheets therefrom. Within the chain loop 2 between the lower sprocket wheel 4.1 and a suction roller 6 is disposed a sheet-guidance arrangement 7 extended over the entire width of the chain loop. The structure and the function of the sheet-guidance arrangement are disclosed in detail in applicants' U.S. Pat. No. 4,225,129 the entire disclosure of which is incorporated herewith by reference.

A dryer 8 is positioned within the chain loop 2. The dryer is of a known per se construction and is not therefore disclosed herein in detail. It may be a commercially available ultra-violet or infrared dryer.

Figure 2:
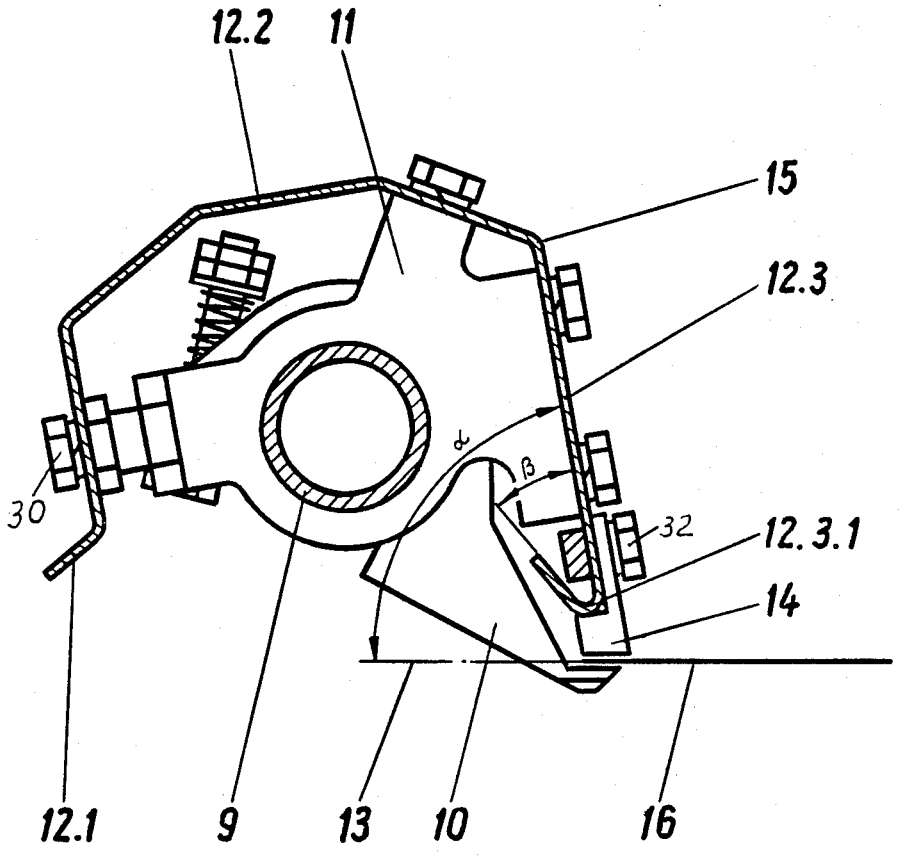
FIG. 2 is a partially sectional view through the sheet pick-up unit of the invention.

Referring now to FIG. 2, which shows the pick-up unit 3, this unit comprises a gripper shaft 9 which is rotated by any suitable conventional means and a plurality of grippers 10 rigidly connected to shaft 9. A number of bars 11 which are distributed over the width of the pick-up unit 3 and extend from gripper shaft 9 in the outward substantially radial direction hold a cover or traverse 12 at the ends thereof. Traverse 12 is screwed to bars 11 by bolts and nuts 30 as shown in FIG. 2. Traverse 12 surrounds gripper shaft 9 and grippers 10 at three sides. This traverse includes a front portion 12.1, upper portion 12.2 and a rear portion 12.3. It is, of course, possible that traverse 12 be connected to bars 11 by any other conventional means, for example by welding. The lower side of the pick-up unit 3 is not closed by traverse 12.

The rear wall portion 12.3 of the traverse is formed with an inwardly extending inclined projection or cant 12.3.1. This projection extends to the plane 13, on which sheets are conveyed along the chain loop 2, at angle $\alpha$. Angle $\alpha$ according to the invention is smaller than 90°. A number of counter gripping elements 14 each corresponding to the respective gripper 10 are rigidly connected for example by bolts 32 to the rear wall of the traverse. In assembly the abutment of the counter gripping element 12.3.1 lies against the cant or projection 12.3.1. This projection contributes a great deal to a high rigidity and high linearity of the pick-up unit in the direction of action of the grippers (perpendicularly to the surface of transporting of the printed sheets). Cant 12.3.1 is formed so that angle $\beta$ which is included between the wall of the projection and the rear wall 12.3 of the traverse is about $\leqq 90°$.

The upper wall 12.2 and the rear wall 12.3 merge one into another at a buckling 15 which further contributes to the high rigidity of the pick-up unit in the direction of the plane of transporting of the printed sheets. The front wall 12.1 also has a similar buckling and merges into the upper wall 12.2 of the traverse 12 at another buckling similar to buckling 15.

The operation mode of the sheet outfeed unit is as follows:

After exiting the last printing station of the printing machine the printed sheet 16 is engaged at its leading edge by the grippers 10 and counter gripping elements 14 of the pick-up unit 3 in the region of sprocket wheel 4.1 and is continuously transported along the length of chain loop 2 to the sheet stack 5. After the respective pick-up unit 3 has reached the position above the sheet stack the grippers 10 are opened in the conventional manner and sheet 16 is released and deposited onto the stack. Before the sheet 16 reaches the suction roller 6, the sheet is dried by radiation of the dryer 8. Suction roller 6 disposed at the edge of the sheet stack serves for sucking and braking the sheet 16 transported towards the sheet stack 5 so as to ensure that sheet 16 will be deposited onto the stack.

The arrangement of the rear wall 12.3 of the traverse at the angle $\alpha$ smaller than 90° ensures a sufficient extension of the operation range of the radiation of the dryer 8, applied to the printed sheets, particularly in the region of the sheet lying near the counter gripping elements 14. Thereby a uniform drying of the printed sheet 16 is warranted. The improper distribution of ink on the printed sheet and thus the worsening of its quality are thereby avoided.

Bucklings 15 at the front and upper and upper and rear walls of the traverse 12 as well as projection 12.3.1 on the rear wall 12.3 substantially improve the rigidity and tensile strength of the pick-up unit 3 despite the fact that traverse 12 is formed of relatively thin sheet material. The cant or projection 12.3.1 makes it possible that the abutments of all counter gripping elements 14 extend parallel to the plane of transporting of printed sheets 13 so that the counter gripping elements can be secured to the rear wall of the traverse without any additional adjustment.

Due to the fact that the pick-up unit 3 is open from below, the assembling or dissassembling (in the case of wear) as well as an adjustment of grippers 10 can be carried out without disassembling of gripper shaft 9.

It will be understood that each of the elements described above, or two or more together, may also find a useful application in other types of sheet pick-up units differing from the types described above.

While the invention has been illustrated and described as embodied in a pick-up unit in a sheet-transporting device of a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sheet transport device of a printing machine, wherein transported sheets are moved along a path defined by a sheet-transport means by a plurality of pick-up units for gripping the sheet and transporting it along said path from a last printing station to a sheet stack, the pick-up unit comprising a gripper shaft; a plurality of grippers connected to said gripper shaft and a plurality of counter gripping elements cooperating with the respective grippers for engaging the sheet being transported; and a traverse carrying said counter gripping elements and enclosing the pick-up unit at three sides thereof, said traverse including a front wall portion, an upper wall portion and a rear wall portion merging one into another, said rear wall portion extending to a plane of transporting of the sheets at an angle $\alpha$ which is smaller than 90°, said rear wall portion carrying said counter gripping elements and being provided with an inclined projection extended inwardly of said rear wall portion.

2. The pick-up unit as defined in claim 1, further including a number of bars outwardly extended from the gripper shaft, said traverse being screwed to said bars.

3. The pick-up unit as defined in claim 1, wherein said front wall portion and said upper wall portion are formed with bucklings.

4. The pick-up unit as defined in claim 1, wherein said projection and said rear wall portion include between each other an angle $\beta$ which is $\leqq 90°$.

* * * * *